US006896530B2

(12) United States Patent
Nishio et al.

(10) Patent No.: US 6,896,530 B2
(45) Date of Patent: May 24, 2005

(54) CONNECTOR PROVIDED WITH SHUTTER

(75) Inventors: Atsushi Nishio, Tokyo (JP); Yoshinori Ota, Tokyo (JP); Yuji Tsujii, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/880,086

(22) Filed: Jun. 30, 2004

(65) Prior Publication Data

US 2005/0026481 A1 Feb. 3, 2005

(30) Foreign Application Priority Data

Jul. 31, 2003 (JP) ..... P2003-284463

(51) Int. Cl.[7] ..... H01R 13/44
(52) U.S. Cl. ..... 439/137
(58) Field of Search ..... 439/137, 139, 439/140, 141, 145, 144

(56) References Cited

U.S. PATENT DOCUMENTS 3,865,456 A * 2/1975 Dola ..... 439/137
4,493,517 A * 1/1985 Hillary ..... 439/140
5,020,997 A * 6/1991 Calderara et al. ..... 439/137
5,915,981 A * 6/1999 Mehta ..... 439/137
6,146,160 A * 11/2000 Chang ..... 439/137
6,149,446 A * 11/2000 Yu ..... 439/137
2003/0077929 A1 * 4/2003 Funatsu ..... 439/137
2003/0148645 A1 * 8/2003 Hashimoto ..... 439/137

FOREIGN PATENT DOCUMENTS

JP 2003-36921 2/2003

* cited by examiner

*Primary Examiner*—Tho D. Ta
(74) *Attorney, Agent, or Firm*—Whitman, Curtis & Christofferson, PC

(57) ABSTRACT

A housing body is formed with an opening, and a cavity communicated with the opening and into which a mating connector terminal inserted through the opening in a first direction is fitted. An internal terminal is provided in the cavity to be electrically connected to the mating connector terminal fitted into the cavity. A pair of shutter members are disposed outside the cavity such that a part of each of the shutter members is movable in a second direction which is perpendicular to the first direction, between a first position for concealing a part of the opening and a second position for revealing the part of the opening. An urging member urges each of the shutter members toward the first position, so that the mating connector terminal moves the shutter members toward the second position against an urging force of the urging member when the mating connector terminal is fitted into the cavity.

6 Claims, 6 Drawing Sheets

CONNECTOR PROVIDED WITH SHUTTER

BACKGROUND OF THE INVENTION

This invention relates to a connector provided with a shutter, and more particularly to a connector which is used in a cradle for effecting a reproducing/displaying processing of an image captured by an electronic camera, an image printing processing and other image processing and also for charging a battery used in an electronic camera, or is used as a connector for electrically connecting electronic equipments together.

In image information recording/reproducing equipment (such as a digital camera, a liquid crystal display and a magnetic storage/reproduction unit), information processing equipment (such as a personal computer, a printer, a display, an image scanner and a facsimile) and other electronic equipment, the transmission of a signal between such electronic equipment and the supply of electric power to the electronic equipment are carried out via a cable, and the connection of the cable is made by fitting a connector provided at a distal end of the cable into a connector provided at an equipment body.

Generally, when a connector is not in use, an opening in a connector fitting section of the connector (into which a mating connector terminal is inserted) is kept open. When such a connector under the non use condition is exposed to the ambient air for a long time, dust deposits on internal terminals (contacts) provided within the connector fitting section, or the internal terminals can corrode, which leads to a possibility that incomplete contact is encountered when the mating connector terminal is inserted into the connector fitting section.

In view of the above, Japanese Patent Publication No. 2003-36921A discloses a connector structure capable of covering such internal terminals when the connector is not in use. This connector comprises a shutter member movable within a connector fitting section in the fitting direction of the connectors, and a coiled spring which is provided within the connector fitting section, and normally urges the shutter member toward the opening receiving a mating connector terminal.

When the mating connector terminal is not inserted in the connector fitting section, the shutter member is urged by the coiled spring toward the opening so as to cover the internal terminals. When the mating connector terminal is inserted into the connector fitting section, the shutter member is pressed by a distal end of the mating connector terminal. In accordance with the insertion of the mating connector terminal, the thus pressed shutter member is moved against the bias of the coiled spring, thus enabling the insertion of the mating connector terminal. As a result, the mating connector terminal contacts the internal terminals of the connector within the connector fitting section, and is electrically connected thereto. However, this connector structure has the following drawbacks.

(a) Since a gap between the shutter member and an inner side face of the connector fitting section is made as small as possible in order to achieve a shutter effect, the shutter member and the internal terminals within the connector fitting section are disposed very close to each other. Therefore, when the shutter member moves within the connector fitting section, a side edge of the shutter member sometimes contacts the internal terminals within the connector fitting section, and therefore fails to smoothly move. In addition, when the mating connector terminal is withdrawn, so that the coiled spring must move the shutter member toward the opening in accordance with this withdrawing movement, the coiled spring or the shutter member is sometimes caught, so that the shutter member is held in a retracted position.

(b) Since the shutter member moves in the fitting direction of the connectors, within a space between opposite inner side faces of the connector fitting section, it is impossible to eliminate gaps between the side edges of the shutter member and the inner side faces of the connector fitting section. In a case where the internal terminals are arranged on the inner side faces, the internal terminals are actually exposed to the exterior through the small gaps. Therefore, the above problems in connection with the dust invasion cannot be avoided.

SUMMARY OF THE INVENTION

It is therefore an object of the invention to provide a connector provided with a shutter, which is capable of positively covering a connector fitting section in such a manner that any gap through which internal terminals are exposed to the exterior is eliminated.

In order to achieve the above object, according to the invention, there is provided a connector, comprising:

a housing body, formed with an opening, and a cavity communicating with the opening and into which a mating connector terminal inserted through the opening in a first direction is fitted;

an internal terminal, provided in the cavity to be electrically connected to the mating connector terminal fitted into the cavity;

a pair of shutter members, disposed outside the cavity such that a part of each of the shutter members is movable in a second direction which is perpendicular to the first direction, between a first position for concealing a part of the opening and a second position for revealing the part of the opening; and an urging member, which urges each of the shutter members toward the first position, so that the mating connector terminal moves the shutter members toward the second position against an urging force of the urging member when the mating connector terminal is fitted into the cavity.

With this configuration, the size of the shutter members are not so limited. Therefore, the pair of shutter members having a sufficient size to cover the opening of the cavity are used. When the shutter members are placed in the first position, the opening is completely concealed without forming any gap through which the internal terminal is exposed to the exterior. Accordingly, dust and other objects are almost completely prevented from intruding into the cavity from the exterior.

Preferably, one side edge of one of the shutter members are abutted against one side edge of the other one of the shutter members when the shutter members are placed at the first position. An outer face of each of the shutter members is formed with a slope face slanted in the first direction toward the one side edge thereof.

With this configuration, the slope faces serve as the guide portions for the insertion of the mating connector terminal. Therefore, as the mating connector terminal is attached in registry with the guide portions, the pair of shutter members are opened in the second direction, respectively. As a result, the guiding of the mating connector terminal and the opening of the shutter members are effected at the same time, and therefore the mating connector terminal can be easily fitted into the cavity.

Preferably, the shutter members are comprised of a synthetic resin material.

With this configuration, the shutter members can be easily formed, for example, by an injection molding technique. In addition, it is possible to secure the insulation with respect to the mating connector terminal which is abutted against the shutter members.

Preferably, a casing covers at least a part of the housing body. The shutter members are attached on an inner face of the casing so as to be pivotable in a double hinged door manner.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Figure 1:
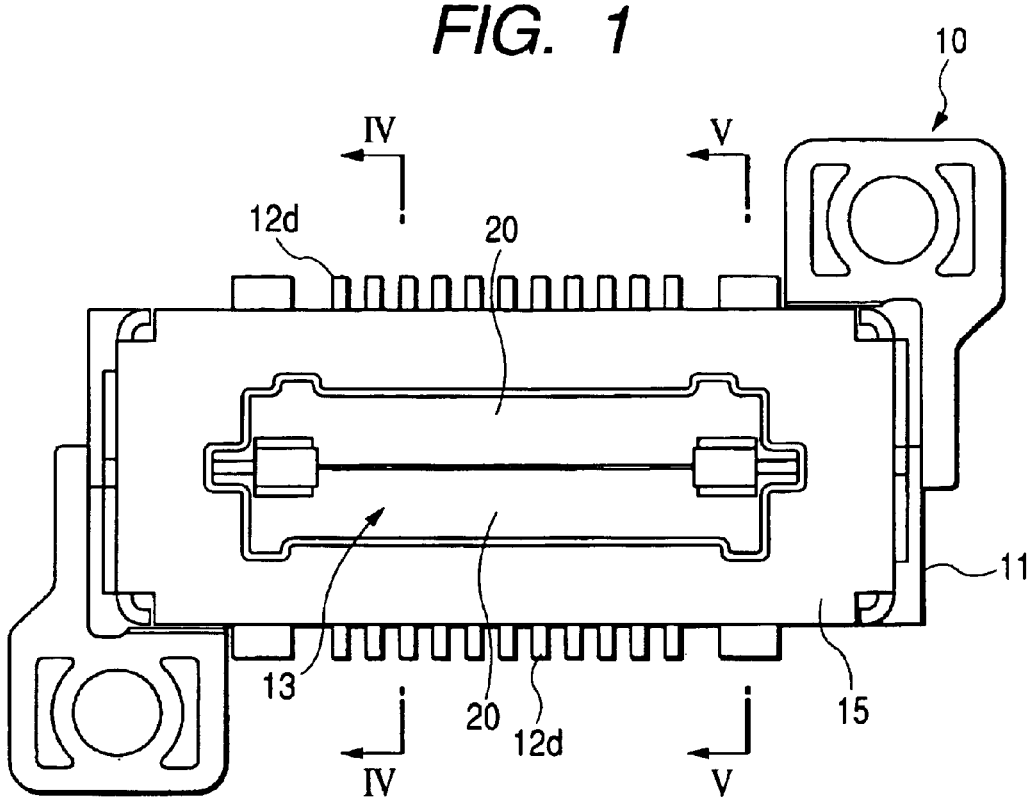
FIG. 1 is a front view of a connector according to a first embodiment of the invention.
Figure 2:
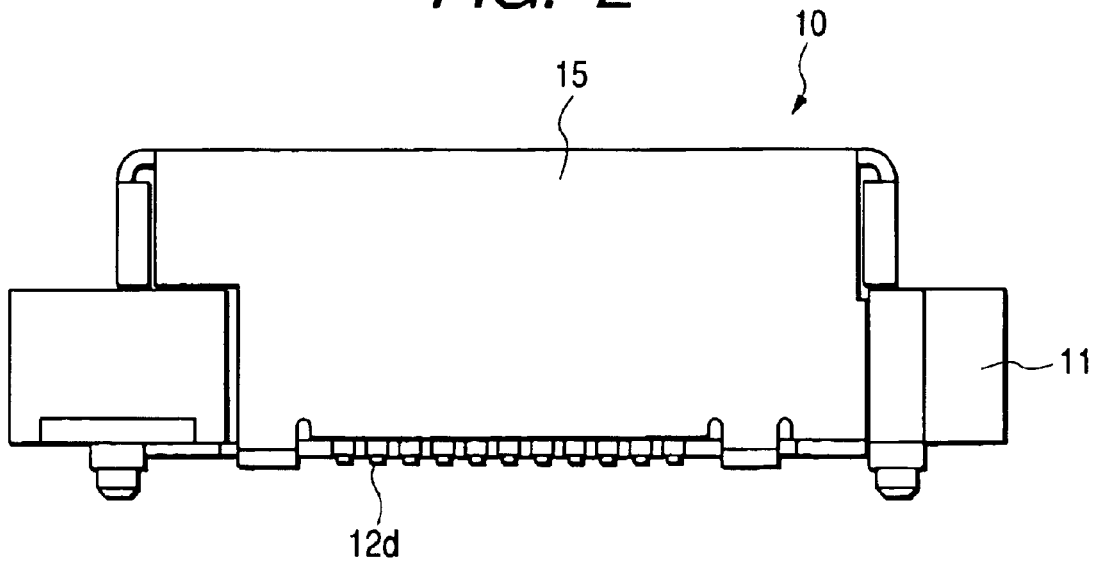
FIG. 2 is a top side view of the connector of FIG. 1.
Figure 3:
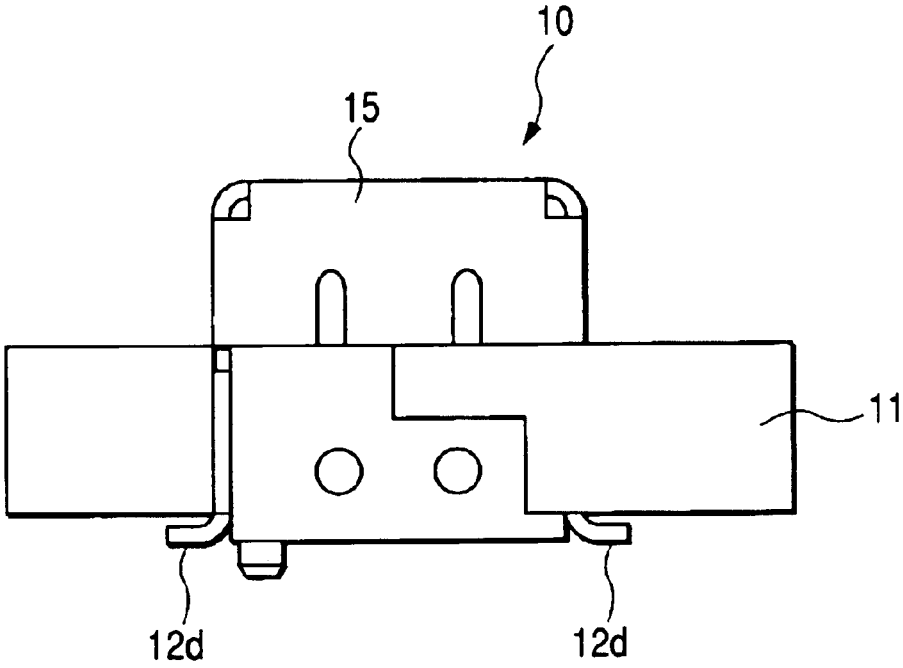
FIG. 3 is a right side view of the connector of FIG. 1.

Preferred embodiments of the present invention will be described below in detail with reference to the accompanying drawings. FIGS. 1 to 6 show a connector 10 according to a first embodiment of the invention. The connector 10 comprises a housing 11, contacts 12, a shutter 13, springs 14, and a shield casing 15.

Figure 4A:
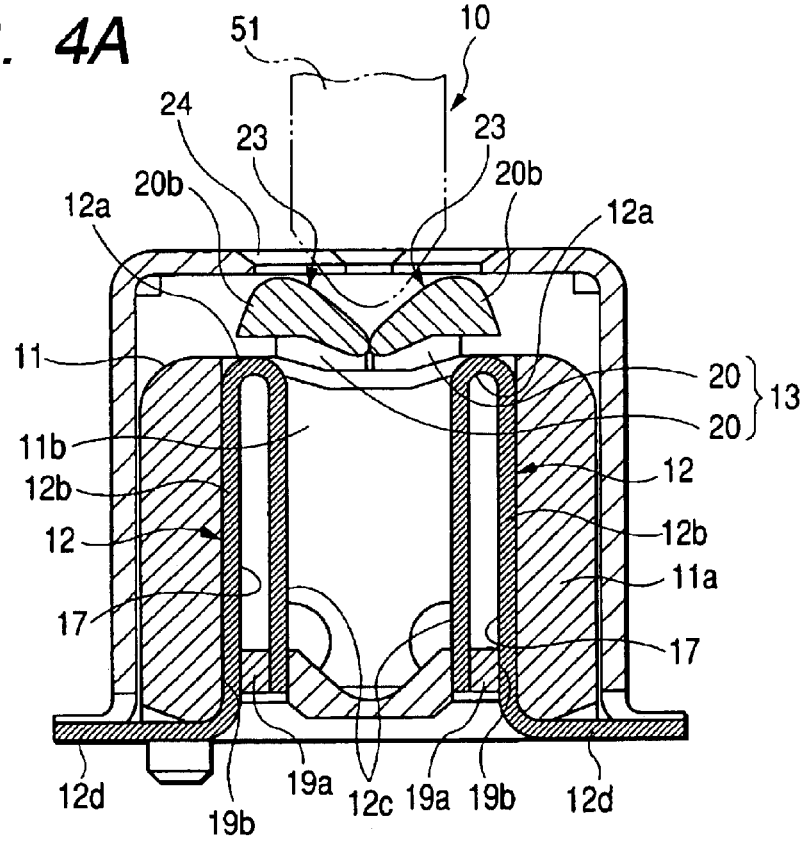
FIG. 4A is a section view taken along a line IV—IV in FIG. 1, showing a state that a shutter in the connector is closed.
Figure 4B:
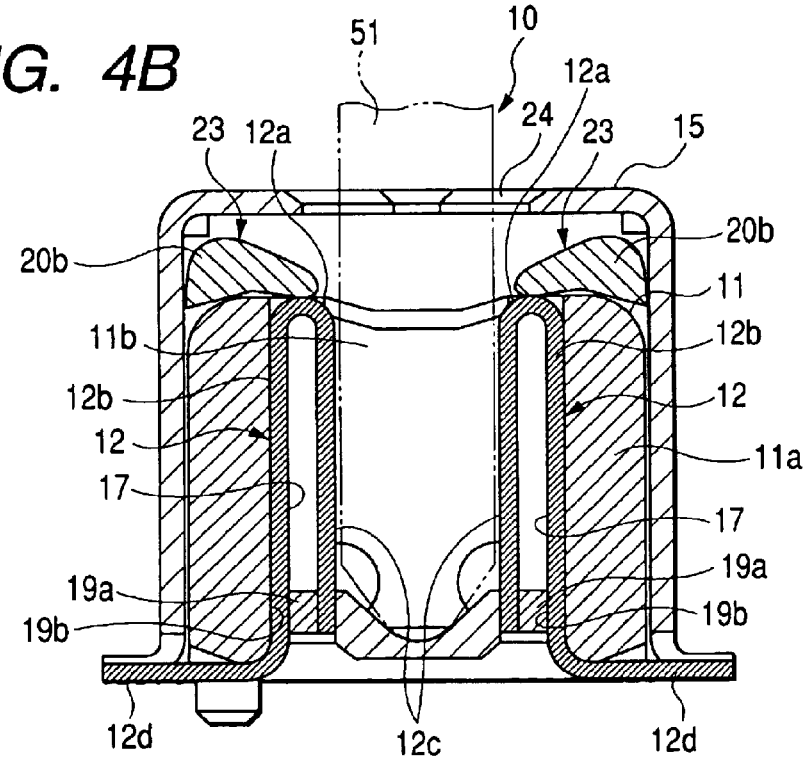
FIG. 4B is a section view taken along the line IV—IV in FIG. 1, showing a state that the shutter is opened.
Figure 5A:
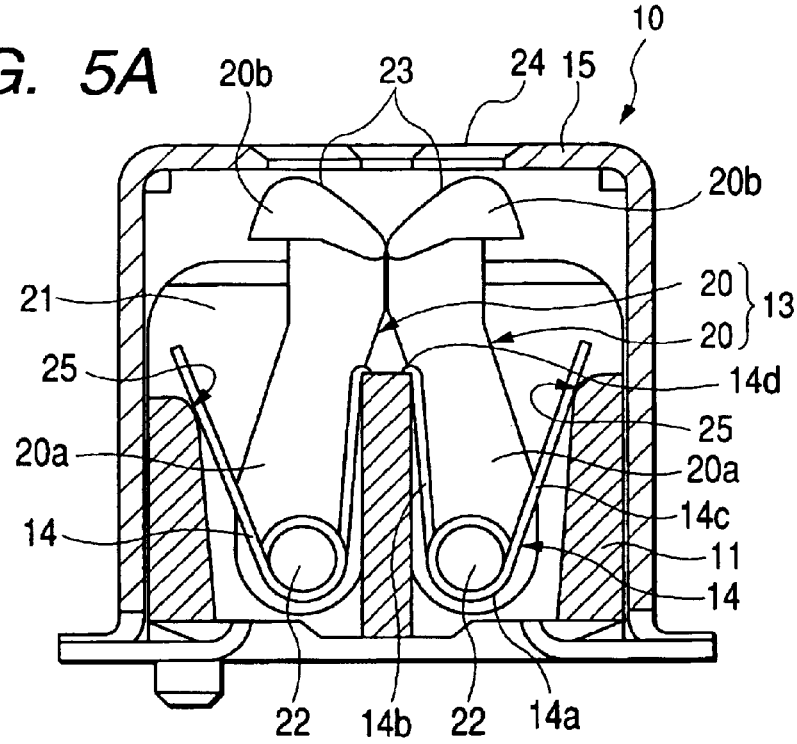
FIG. 5A is a section view taken along a line V—V in FIG. 1, showing a state that the shutter is closed.
Figure 5B:
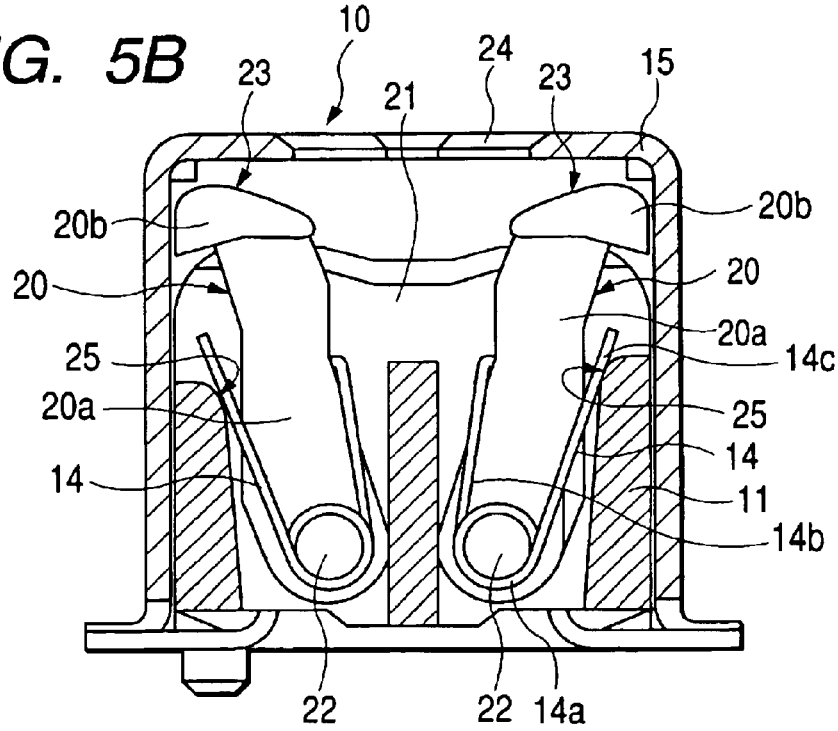
FIG. 5B is a section view taken along the line V—V in FIG. 1, showing a state that the shutter is opened.

The housing 11 is made of a resin material such as nylon. As shown in FIGS. 1 to 5, this housing 11 includes a rectangular box-shaped housing body 11*a*. The housing body 11*a* is formed with an opening formed in an upper face thereof for receiving a mating connector terminal therethrough, and a rectangular cavity 11*b* (hereinafter referred to as "connector fitting section") communicating with the opening. As shown in FIGS. 1, 4A and 4B, a plurality of grooves 17 are arranged on each of opposed longitudinal inner side faces so as to extend in the extending direction of the connector fitting section. As shown in FIGS. 1, 5A and 5B, a recess 21 for receiving the shutter 13 is formed at each of the longitudinal side ends of the connector fitting section 11*b*. The recess 21 is opened so as to communicate with the connector fitting section 11*b* at an upper side of the housing body 11*a*. At the bottom portion of the connector fitting section 11*b*, a pair of through holes 19*a* and 19*b* are formed so as to communicate with each of the grooves 17.

Each of the contacts 12 is formed by a narrow conductive material such as a copper alloy. Each contact 12 is so bent as to form a U-shaped upper portion 12*a* and an intermediate portion 12*b* to be press-fitted into the corresponding groove 17, and end portions 12*c* and 12*d* to be inserted respectively in the corresponding pair of through holes 19*a* and 19*b*. In this way, each contact 12 is mounted in the housing 11 in such a manner that one end portion 12*c* of the contact 12 is retained in one through hole 19*a*, while the other end portion 12*d* is passed through the through hole 19*b*. After the contact 12 is mounted in the housing 11, the end portion 12*d* projected from the bottom face of the housing 11 is bent outward such that this bent portion serves as an external terminal for connection to a board or the like. On the other side, the contacts 12 arranged in the connector fitting section 11*b* serve as internal terminals.

Figure 6:
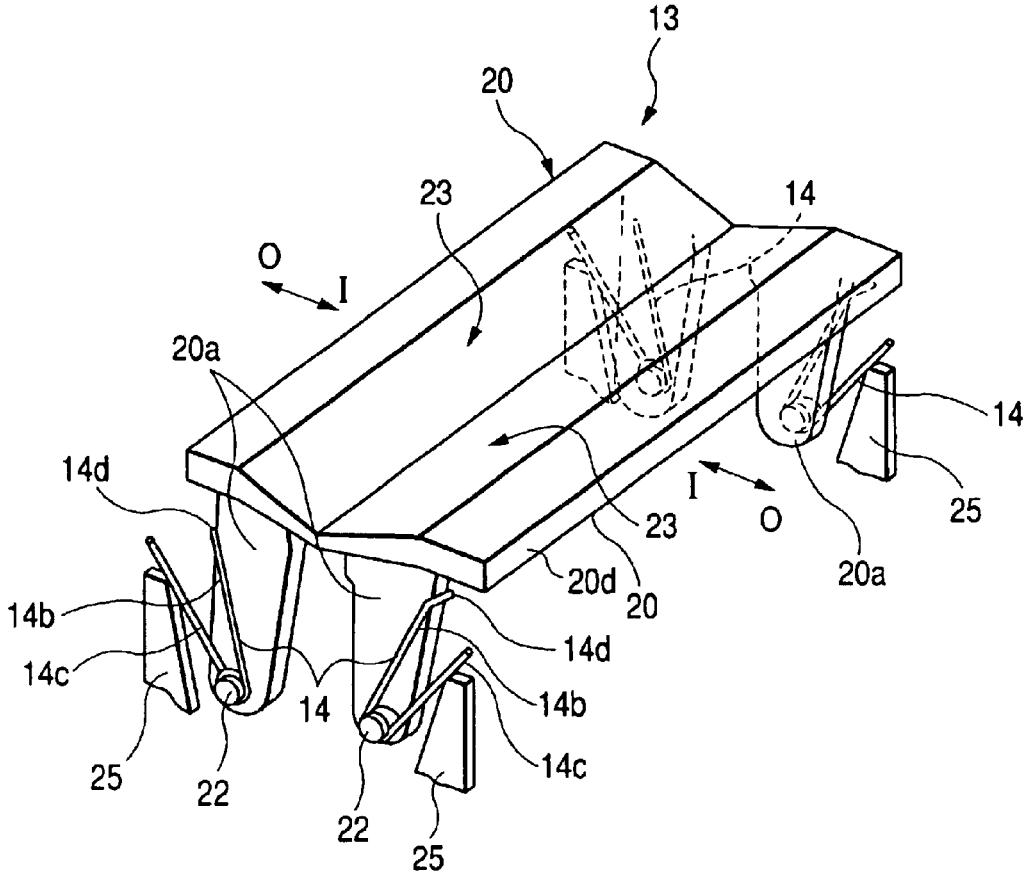
FIG. 6 a perspective view of the shutter.

As shown in FIGS. 1 and 6, the shutter 13 comprises a pair of shutter members 20 which are configured symmetrically. Each of the shutter members 20 includes a shutter plate 20*b* and arm portions 20*a* which are extended perpendicularly from both longitudinal side ends of the shutter plate 20*b*. The shutter plate 20*b* and the arm portions 20*a* are integrally molded with synthetic resin such as PPS resin. A pivot shaft 22 is projected from the outer face of each arm portion 20*a*. Each arm portion 20*a* is disposed in the recess 21 such that the pivot shaft 22 is fitted into a hole (not shown) formed in the recess 21 and is rotatably supported thereat. Accordingly, the shutter member 20 is made pivotable in the lateral direction (i.e., the direction perpendicular to the fitting direction of the mating connector).

The shutter plate 20*b* has such a size that it substantially closes a right half (or a left half) of the opening of the connector fitting section 11*b* when the shutter is closed as shown in FIG. 4A, and that completely retracts from a position immediately above the opening in the connector fitting section 11*b* when the shutter is open as shown in FIG. 4B. A slope guide face 23 is formed on the upper face of each of the shutter plates 20*b*. Specifically, the slope guide face 23 is formed at one longitudinal side of the shutter plate 20*b* which opposes to the other shutter plate 20*b*. The slope guide face 23 of one shutter plate 20*b* is downwardly slanted toward the other shutter plate 20*b*.

As shown in FIG. 6, each of, the springs 14 is a torsion spring formed by winding a single metal rod member, so as to include a coil portion 14*a*, and end portions 14*b* and 14*c* extending from the coil portion 14*a* outwards.

Before mounting the shutter member 20 on the housing body 11*a*, the coil portion 14*a* of the spring 14 is fitted with the shaft 22 of the arm portion 20*a*. Then, a claw 14*d* formed at the end portion 14*b* of the spring 14 is hooked on a part of the arm portion 20*a*. When the arm portion 20*a* is inserted into the recess 21, the end portion 14*c* of the spring 14 is abutted against a spring stopper 25. With the further insertion of the arm portion 20*a*, the shaft 22 is fitted into the above-described hole in the recess 21 while compressing the end portions 14*b* and 14*c* of the spring inwards.

In this condition, a repulsion force of each spring 14 acts between the corresponding arm portion 20*a* and spring retainer portion 25. These spring compression forces, acting on each shutter member 20, always impart a force to this shutter member 20 so as to pivot the same in a direction indicated by arrows "I" in FIG. 6. When the connector is not in use, the shutter members 20, subjected to the spring repulsion forces, are held in abutting contact with each other at the inner ends of the slope guide faces 23 of the shutter plates 20*b*, and therefore the shutter is kept in the closed condition.

The box-shaped shield casing 15 has such a size that this shield casing 15 can cover the shutter 13 and the housing body 11*a* except the bottom face of this housing body 11*a*. The shield casing 15 is formed by pressing a thin metal sheet (such as a copper alloy sheet), and the surface of the shield casing 15 is plated with nickel. A rectangular opening 24 is formed through an upper wall of the shield casing 15, and is disposed in registry with the connector fitting section 11*b* of the housing 11, and this opening 24 is slightly larger in size than the connector fitting section 11*b*, and is generally equal in shape to the opening in the connector fitting section 11*b*.

The connection of an external connector to the thus assembled connector 10 will be described. FIGS. 4A and 5A show a condition in which a mating connector terminal 51 is disposed at the upper side of the connector 10, and FIGS. 4B and 5B show a condition in which the mating connector terminal 51 is connected to the connector 10. The mating connector terminal 51 is a male-type terminal to be fitted into the connector terminal portion 11*b* of the connector 10, and a plurality of contacts, corresponding respectively to the contacts 12 of the connector 10, are arrayed on an outer face of the terminal 51. A distal end of the terminal 51 is chamfered so that this terminal portion can be easily inserted.

When the mating connector terminal 51 is disposed at the upper side of the connector 10, and is not yet inserted between the pair of shutter members 20 as shown in FIGS. 4A and 5A. In this condition, the pair of shutter members 20 have been pivotably moved inwardly (respectively in the directions indicated by the arrows "I" in FIG. 6) about the pivot shafts 22 into their respective shutter-closing positions by the urging forces of the springs 14. In this shutter-closed condition, the pair of shutter plates 20*b* completely close the opening 24 in the shield casing 15 from the inside thereof, and also the pair of shutter plates 20*b* completely closes the opening of the connector fitting section 11*b* of the housing 11 from the outside thereof. FIG. 1 also shows the closed condition of the shutter. Therefore, in the closed condition of the shutter 13, the interior of the connector fitting section 11*b* is concealed by the pair of shutter plates 20*b*, and the internal terminals (contacts 12) can not be seen from the outside of the shield casing 15.

When the mating connector terminal 51 is inserted into the interior of the connector 10 via the opening 24 in the shield casing 15, the chamfered distal end of the mating connector terminal 51 abuts against the recessed portion of the upper face of the shutter 13 defined by the slope guide faces. Because of provision of the slanting guide faces 23, a central portion of the upper face of the shutter 13, defined by the upper faces of the pair of shutter plates 20, is recessed so as to have a V-shaped cross section. When the mating connector terminal 51 is inserted toward the connector fitting section 11*b*, this recessed portion serves as a guide for this insertion, and also serves to efficiently converts a pressing force applied from the mating connector terminal 51 into a force for pivoting the pair of shutter members 20 outwardly away from each other. In other words, the slope guide faces 23 facilitate the inserting operation of the mating connector terminal 51.

Accordingly, the pair of shutter members 20 are automatically pivoted outwardly (respectively in directions indicated by arrows "O" in FIG. 6) about the pivot shafts 22 against the bias of the springs 14. As a result of this pivotal movement, the shutter plates 20*b* are retracted outward. Namely, the shutter 13 is gradually opened, so that the connector fitting section 11*b* appears. As the shutter 13 is thus opened, the mating connector terminal 51 is inserted into the connector fitting section 11*b*.

After the pair of shutter members 20 are completely retracted from the position above the opening in the connector fitting section 11*b*, that is, are moved into their respective shutter-opening positions, the mating connector terminal 51 is smoothly inserted and fitted into a predetermined position within the connector fitting section 11*b*, so that the contacts of the mating connector terminal 51 are electrically connected respectively to the contacts 12 of the connector 10. The predetermined position into which the mating connector terminal 51 is inserted is, for example, a position where the mating connector terminal 51 abuts against the bottom face of the connector fitting section 11*b*. FIGS. 4B and 5B show the condition of the shutter 13 in which the mating connector terminal 51 is inserted into the predetermined position within the connector fitting section 11*b*, that is, the open condition of the shutter.

Next, the removal of the mating connector terminal 51 from the connector 10 will be described. For removing the mating connector terminal 51 from the connector 10, a force for withdrawing the mating connector terminal 51 from the connector fitting section 11*b* is applied to the mating connector terminal 51. When the distal end of the mating connector terminal 51 completely passes the pair of shutter plates 20*b* in this withdrawing operation, the pair of shutter members 20 are pivoted about the pivot shafts 22 respectively in the directions indicated respectively by the arrows "I" in FIG. 6) by the resilient forces of the always-compressed springs 14, and therefore are automatically returned to their respective shutter-closing positions where the shutter plates 20*b* of the shutter members 20 are held in abutting contact with each other at the inner ends of the guide faces 23. Namely, the shutter is returned to the closed condition.

The shutter members 20 moves within the space formed between the inner side of the shield casing 15 and the outer side of the housing 11 in the direction perpendicular to the fitting direction of the mating connector so as to completely cover the opening of the connector fitting section 11*b* in which the internal terminals (the contacts 12) are arranged. Therefore, when the connector 10 is not in use, dust and other objects are almost completely prevented from intruding from the exterior into the connector fitting section 11*b*.

Furthermore, the shutter members 20 will not interfere with the internal terminals when the shutter members 20 moves to open or close the opening of the connector fitting section 11*b*, thereby attaining the smooth movement of the shutter members 20. In addition, since the springs 14 for urging the shutter members 20 toward the shutter-closing positions are the torsion springs, the shutter members 20 will not be caught in the shutter-opening positions, thereby surely attaining the shutter-closing operation.

Moreover, the pair of shutter members 20 are made of synthetic resin, and therefore can be easily formed, using an injection molding technique. And besides, when attaching and detaching the mating connector terminal 51, the shutter members are kept insulated from this mating connector terminal 51.

Figure 7A:
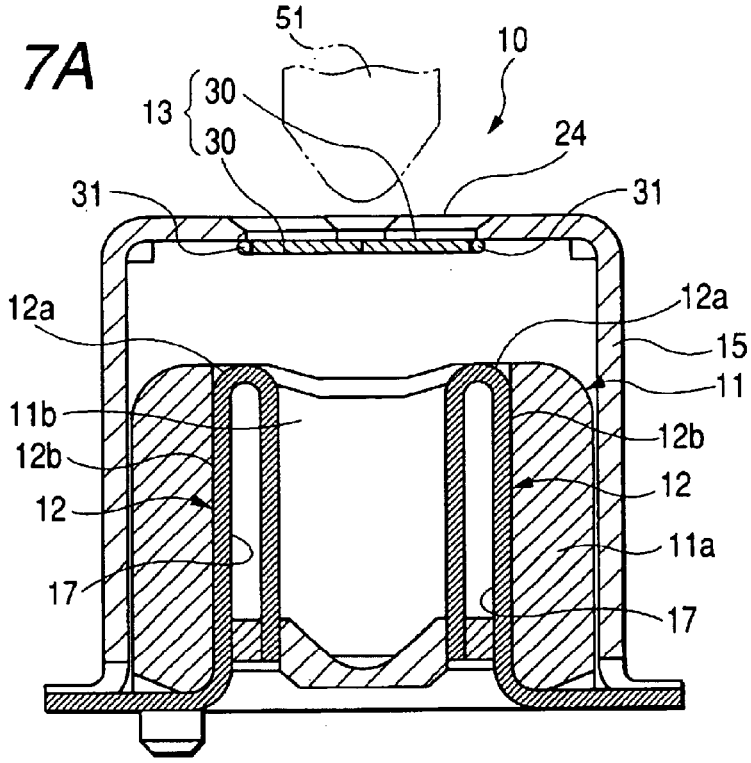
FIG. 7A is a section view showing a state that a shutter in a connector according to a second embodiment of the invention is closed.
Figure 7B:
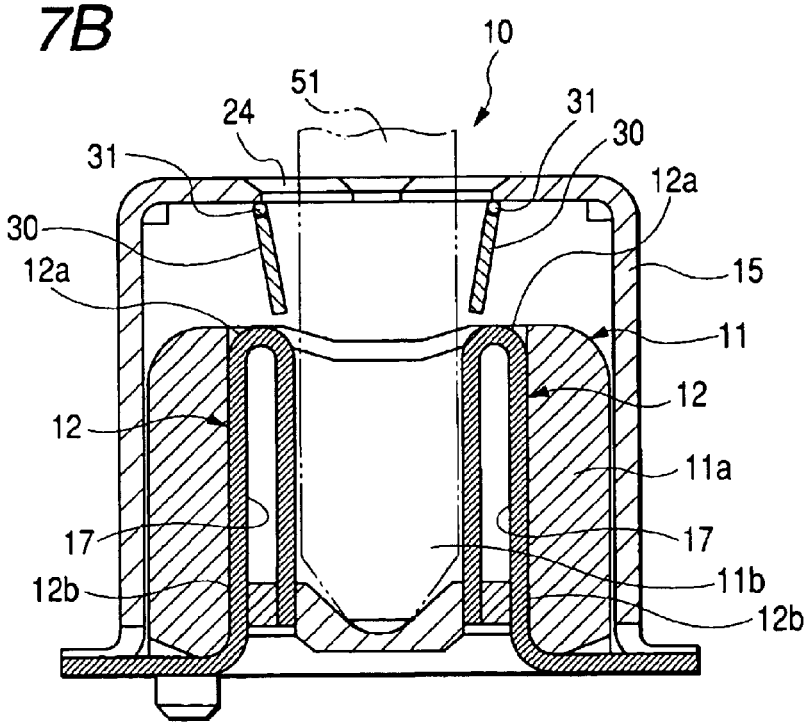
FIG. 7B is a section view showing a state that the shutter of FIG. 7A is opened.

FIGS. 7A and 7B show a connector according to a second embodiment of the invention. In this embodiment, a shutter 13 comprises a pair of shutter members 30 which are configured in a hinged double door manner and are attached on the periphery of an opening 24 of a shield casing 15. Any other respects are as same as the first embodiment. The members similar to those in the first embodiment will be designated by the same reference numerals and the repetitive explanations for those will be omitted.

Each of the shutter members 30 is made of synthetic resin such as PPS resin so as to have a thin rectangular shape, and have such a size as to completely close a half of the opening 24 of the shield casing 15. An outer longitudinal side edge of each shutter member 30 is attached on an inner face of the shield casing 15 through a hinge 31 so as to be pivotable upward or downward. On the other hand, a distance between the inner face of the shield casing and the top face of the housing 11 is so determined as to have a dimension of the short-side width of each shutter member 30, thereby allowing the pivotal movement of the shutter members 30. The hinge 31 is provided with an urging member such as a torsion spring for always urging the shutter member 30 upward. Accordingly, when the mating connector terminal 51 is not fitted into the connector fitting section 11*b*, each shutter member 30 is brought into contact with the inner face of the shield casing 15 by the urging force of the urging member in the hinge 31, so as to close the half of the opening 24. FIG. 7A shows a condition that the shutter members 30 thus configured completely closes the opening 24. In this condition, the interior of the connector fitting section 11*b* is concealed by the pair of shutter members 30, and internal terminals (the contacts 12) can not be seen from the outside of the shield casing 15.

Then, the mating connector terminal 51 is inserted through the opening 24 of the shield casing 15 until it is brought into abutting contact with the shutter members 30, the pair of shutter members 30 are automatically pivoted downward about the respective hinges 31 against the bias of the urging members, and are opened away from each other. Thus, the shutter members 30 are retracted outward in the opposite directions (in the directions perpendicular to the fitting direction of the mating connector terminal 51), respectively. As a result of this pivotal movement of the shutter members 30, an opening of the connector fitting section 11*b* appears.

After the pair of shutter members 30 are pivoted respectively in the lateral directions to be substantially retracted from a position above the opening in the connector fitting section 11*b*, that is, are pivotably moved into their respective shutter-opening positions, the mating connector terminal 51 is smoothly inserted and fitted into a predetermined position within the connector fitting section 11*b*, so that contacts of the mating connector terminal 51 are electrically connected respectively to the contacts 12 of the connector 10. The predetermined position into which the mating connector terminal 51 is inserted is, for example, a position where the mating connector terminal 51 abuts against a bottom face of the connector fitting section 11*b*. FIG. 7B shows a condition that the shutter members 30 are in the shutter-opening positions, so that the mating connector terminal 51 is inserted into the predetermined position within the connector fitting section 11*b*.

Next, the removal of the mating connector terminal 51 from the connector 10 will be described. For removing the mating connector terminal 51 from the connector 10, a force for withdrawing the mating connector terminal 51 from the connector fitting section 11*b* is applied to the mating connector terminal 51, and the mating connector terminal 51 is withdrawn from the connector fitting section 11*b*. When the distal end of the mating connector terminal 51 completely passes the pair of shutter members 30 in this withdrawing operation, the pair of shutter members 30 are pivoted about the respective hinges 31 by the resilient forces of the urging members, and therefore are automatically returned to their respective shutter-closing positions where the shutter members 30 close the opening 24 in the shield casing 15. Namely, the shutter is returned to the closed condition.

Also in this embodiment, the space immediate above the opening of the connector fitting section 11*b* is closed by the pair of shutter members 30 when the connector 10 is not used, dust and others are almost completely prevented from intruding from the exterior into the connector fitting section, thus enhancing the effect of protection from the exterior.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A connector, comprising:

a housing body, formed with an opening, and a cavity communicating with the opening and into which a mating connector terminal inserted through the opening in a first direction is fitted;

an internal terminal, provided in the cavity to be electrically connected to the mating connector terminal fitted into the cavity;

a pair of shutter members, disposed outside the cavity such that a part of each of the shutter members is movable in a second direction which is perpendicular to the first direction, between a first position for concealing a part of the opening and a second position for revealing the part of the opening; and an urging member, which urges each of the shutter members toward the first position, so that the mating connector terminal moves the shutter members toward the second position against an urging force of the urging member when the mating connector terminal is fitted into the cavity;

wherein one side edge of one of the shutter members are abutted against one side edge of the other one of the shutter members when the shutter members are placed at the first position.

2. The connector as set forth in claim 1, wherein:

an outer face of each of the shutter members is formed with a slope face slanted in the first direction toward the one side edge thereof.

3. The connector as set forth in claim 1, wherein the shutter members are comprised of a synthetic resin material.

4. The connector as set forth in claim 1, further comprising a casing which covers at least a part of the housing body, wherein the shutter members are attached on an inner face of the casing so as to be pivotable in a double hinged door manner.

5. The connector as set forth in claim 1, wherein a central axis of the internal terminal is aligned with the one side edges of the shutter members when the shutter members are placed in the first position.

6. The connector as set forth in claim 1, further comprising a pivot shaft affixed to each of said pair of shutter members, wherein each of said pair of shutter members pivots about said pivot shaft when moving from said first position to said second position.

* * * * *